US010376083B1

(12) United States Patent
Lee et al.

(10) Patent No.: US 10,376,083 B1
(45) Date of Patent: Aug. 13, 2019

(54) STORAGE RACK DEVICE

(71) Applicants: Adrian Lee, Austin, TX (US); Patricia Lee, Austin, TX (US)

(72) Inventors: Adrian Lee, Austin, TX (US); Patricia Lee, Austin, TX (US)

( * ) Notice: Subject to any disclaimer, the term of this patent is extended or adjusted under 35 U.S.C. 154(b) by 0 days.

(21) Appl. No.: 16/011,889

(22) Filed: Jun. 19, 2018

(51) Int. Cl.
*A47G 25/10* (2006.01)
*A47F 7/06* (2006.01)

(52) U.S. Cl.
CPC ..... *A47G 25/10* (2013.01); *A47F 7/06* (2013.01)

(58) Field of Classification Search
CPC ..... A47G 25/10; A47F 7/06; A47B 45/00; G11B 23/0236
USPC ..... 211/30–33, 85.3, 41.12; 403/292, 109.3, 403/108
See application file for complete search history.

(56) References Cited

U.S. PATENT DOCUMENTS 113,530 A * 4/1871 King ..... F16B 7/0413 285/397
120,111 A * 10/1871 Sevy ..... A47B 49/004 312/305
370,989 A * 10/1887 Svensson ..... A47G 25/10 211/30
406,673 A * 7/1889 Seymour ..... A45C 11/02 206/9
486,828 A * 11/1892 Grouleff ..... F25D 23/087 312/296
639,050 A * 12/1899 Hurdel ..... A45C 11/02 206/8
845,739 A * 3/1907 Alson ..... A47F 7/06 211/33
1,282,048 A * 10/1918 Cook ..... F21V 33/00 211/144
1,746,486 A * 2/1930 Martin ..... A47G 25/10 211/105
1,746,487 A * 2/1930 Martin ..... A47G 25/10 211/196
1,820,950 A * 9/1931 Schulstadt ..... E04F 21/1805 182/107
1,927,353 A * 9/1933 Thomas ..... A47F 7/06 211/33
2,213,677 A * 9/1940 Miller ..... A47F 5/02 211/163
2,594,605 A * 4/1952 Zoppelt ..... A47H 1/022 211/123
3,347,575 A * 10/1967 Morris ..... F16B 7/105 16/429
4,993,557 A * 2/1991 Davis ..... A47F 7/06 211/30
5,031,777 A * 7/1991 Knox ..... A47F 5/00 211/163
5,102,173 A * 4/1992 Schallern ..... E05B 65/0888 292/288

(Continued)

*Primary Examiner* — Stanton L Krycinski

(57) ABSTRACT

A storage rack device for storing, shaping, and displaying baseball caps includes a bottom plate, a top plate, and a pair of rods. The rods are coupled to and extend between the bottom plate and the top plate. The rods are opposingly positioned proximate to a lower circumference of the top plate and extend in parallel to the bottom plate. The pair of rods is configured to selectively insert a bill of a cap to couple the cap to the pair of rods so that the bill is selectively positionable in a curved configuration and a flat configuration.

17 Claims, 4 Drawing Sheets

(56) References Cited

U.S. PATENT DOCUMENTS 5,137,157 A * 8/1992 Lawson ..... A47F 7/06 211/32
5,314,077 A * 5/1994 Theosabrata ..... A47B 81/068 211/40
5,341,943 A * 8/1994 Fraser ..... A47B 81/068 206/309
5,343,816 A * 9/1994 Sideris ..... A47B 49/004 108/94
5,348,166 A * 9/1994 Lema ..... A47F 1/085 211/113
5,358,124 A * 10/1994 Mueller ..... A47B 81/067 211/40
5,396,994 A * 3/1995 Fitzgerald ..... A47F 5/0884 211/30
D360,329 S * 7/1995 Chu ..... D6/407
5,450,967 A * 9/1995 Mallory ..... A47F 7/06 211/30
D369,910 S * 5/1996 McCarty ..... D6/320
5,595,312 A * 1/1997 Dardashti ..... A47B 57/34 211/188
5,607,065 A * 3/1997 Todd ..... G11B 23/0236 211/163
5,727,694 A 3/1998 Larson
D393,970 S 5/1998 Lee
5,779,386 A * 7/1998 Eichhorn ..... A47D 13/105 403/109.3
5,921,403 A * 7/1999 Coffaro ..... A47F 7/06 211/30
5,984,115 A * 11/1999 Koestenblatt ..... G11B 33/0472 211/40
6,224,072 B1 * 5/2001 Weck ..... B62B 3/02 211/204
6,293,511 B1 * 9/2001 Shepherd ..... A47B 19/002 248/441.1
6,311,879 B1 11/2001 Rigler et al.
6,315,252 B1 * 11/2001 Schultz ..... B60R 11/0252 108/44
6,422,401 B1 7/2002 Roten
6,581,890 B2 * 6/2003 Johnson ..... A45D 44/04 248/161
6,676,092 B2 * 1/2004 Tsai ..... B65F 1/1415 248/149
6,824,027 B2 11/2004 Frey
6,840,411 B2 1/2005 Fritz
7,182,713 B2 * 2/2007 Wang ..... G06F 3/03543 482/27
7,540,058 B1 * 6/2009 Day ..... B25G 1/04 15/145
8,020,712 B2 9/2011 Kopp et al.
8,439,055 B2 * 5/2013 April ..... A45B 11/00 135/16
8,491,215 B2 * 7/2013 Young ..... B25G 3/18 403/109.3
8,910,800 B1 * 12/2014 Bickford ..... A47G 25/10 211/32
9,044,086 B1 * 6/2015 Johnston ..... A47B 63/02
2006/0021955 A1 * 2/2006 Yu ..... G11B 33/0483 211/40
2010/0096529 A1 * 4/2010 Kritsky ..... E06B 3/44 248/407

* cited by examiner

STORAGE RACK DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to storage devices and more particularly pertains to a new storage device for storing, shaping, and displaying baseball caps.

BRIEF SUMMARY OF THE INVENTION

An embodiment of the disclosure meets the needs presented above by generally comprising a bottom plate, a top plate, and a pair of rods. The rods are coupled to and extend between the bottom plate and the top plate. The rods are opposingly positioned proximate to a lower circumference of the top plate and extend in parallel to the bottom plate. The pair of rods is configured to selectively insert a bill of a cap to couple the cap to the pair of rods so that the bill is selectively positionable in a curved configuration and a flat configuration.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
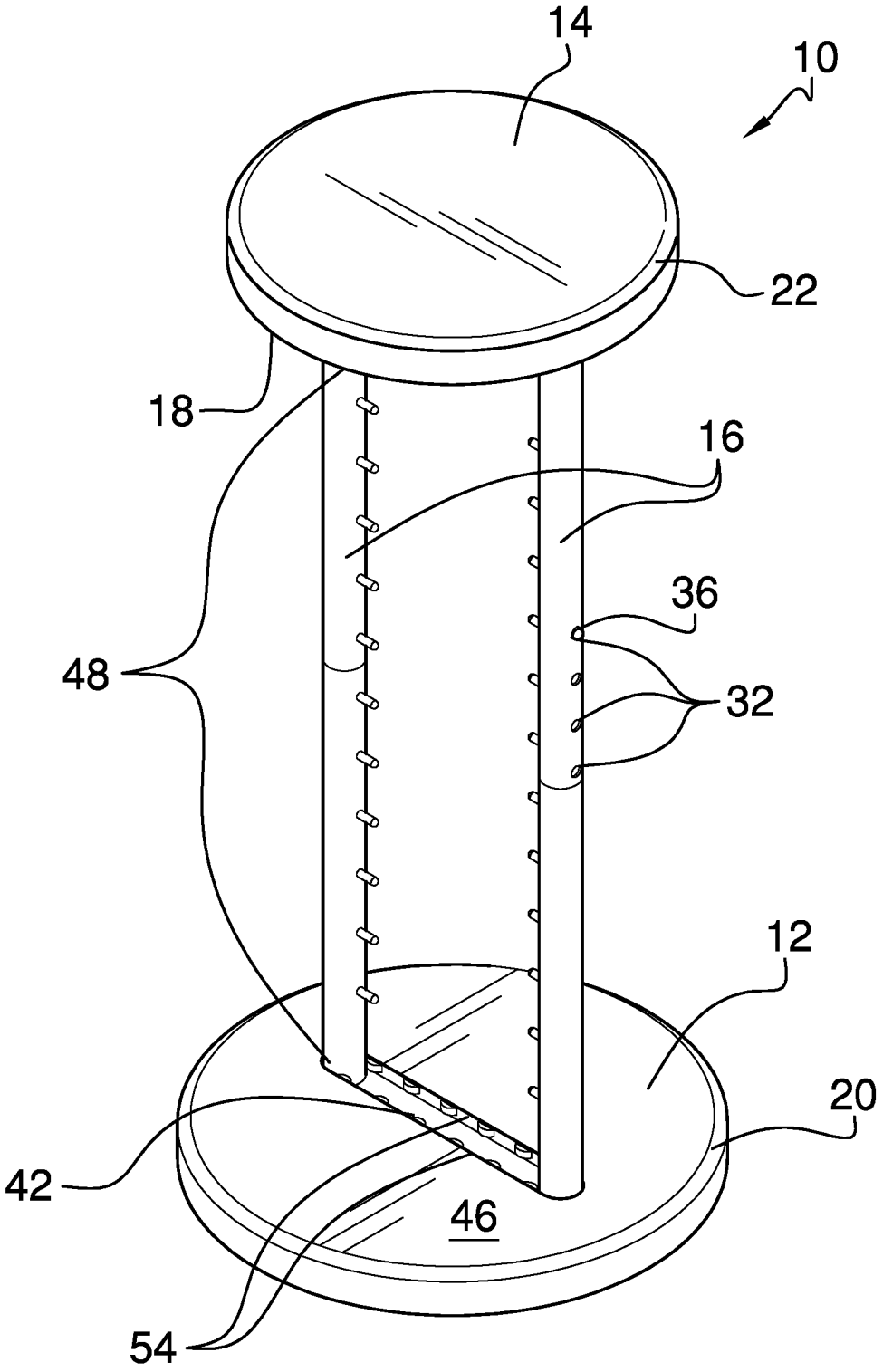
FIG. 1 is an isometric perspective view of a storage rack device according to an embodiment of the disclosure.

With reference now to the drawings, and in particular to FIGS. 1 through 5 thereof, a new storage device embodying the principles and concepts of an embodiment of the disclosure and generally designated by the reference numeral 10 will be described.

Figure 2:
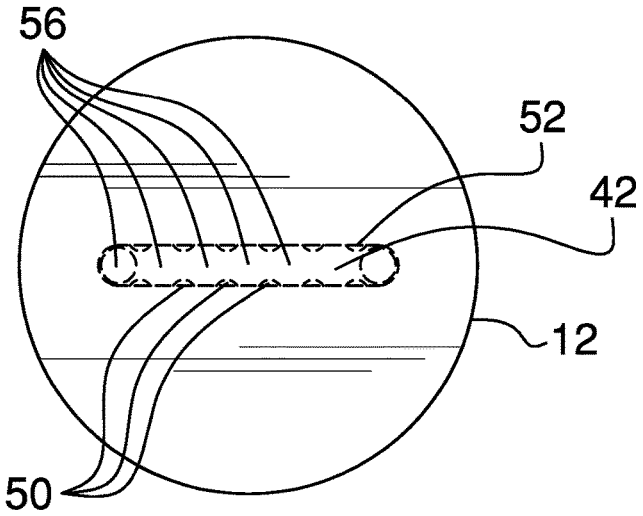
FIG. 2 is a bottom view of an embodiment of the disclosure.
Figure 3:
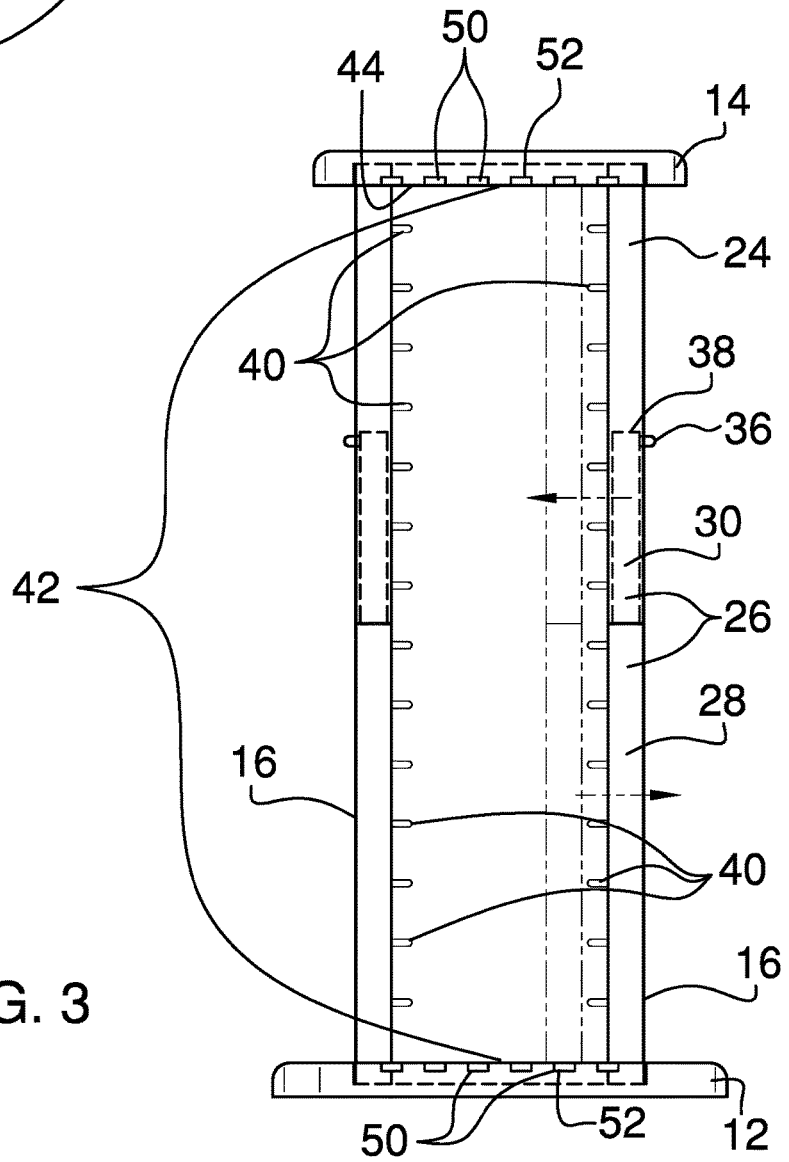
FIG. 3 is a back view of an embodiment of the disclosure.

As best illustrated in FIGS. 1 through 5, the storage rack device 10 generally comprises a bottom plate 12, a top plate 14, and a pair of rods 16. The rods 16 are coupled to and extend between the bottom plate 12 and the top plate 14. The rods 16 are opposingly positioned proximate to a lower circumference 18 of the top plate 14 and extend in parallel to the bottom plate 12, as shown in FIG. 3. The pair of rods 16 is configured to selectively insert a bill of a cap to couple the cap to the pair of rods 16 so that the bill is selectively positionable in a curved configuration and a flat configuration.

The bottom plate 12 and the top plate 14 are circularly shaped. The bottom plate 12 has an upper perimeter 20. The top plate 14 has an upper circumference 22. The upper perimeter 20 and the upper circumference 22 are beveled, as shown in FIG. 1. The top plate 14 is circumferentially smaller than the bottom plate 12. The bottom plate 12, the top plate 14, and the rods 16 comprise wood, plastic, or the like. The rods 16 are circularly shaped when viewed longitudinally.

Figure 4:
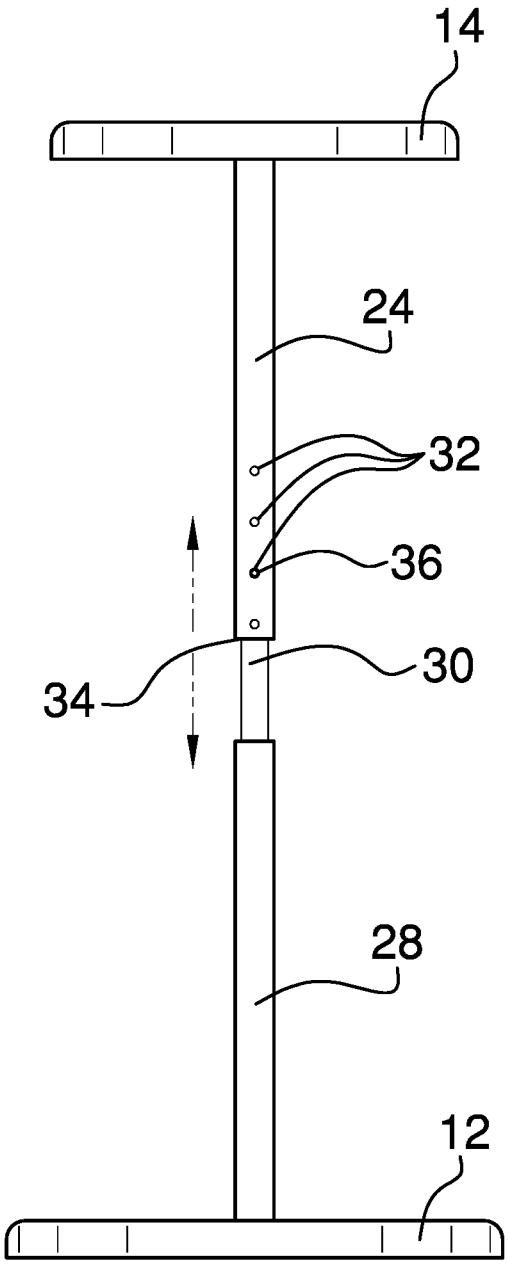
FIG. 4 is a side view of an embodiment of the disclosure.

Each rod 16 comprises an upper segment 24 and a lower segment 26. The upper segment 24 extends from the top plate 14 and is tubular. The lower segment 26 comprises a lower section 28 and an upper section 30, as shown in FIG. 4. The lower section 28 extends from the bottom plate 12. The upper section 30 extends from the lower section 28. The upper section 30 is circumferentially smaller than the lower section 28 so that the upper section 30 is positioned to selectively insert into the upper segment 24 to couple the upper segment 24 to the lower segment 26, as shown in FIG. 4.

A plurality of holes 32 is positioned in the upper segment 24 proximate to a lower end 34 of the upper segment 24, as shown in FIG. 4. The plurality of holes 32 comprises four holes 32. A pin 36 is coupled to the upper section 30 of the lower segment 26 proximate to an upper end 38 of the low segment 26, as shown in FIG. 3. The pin 36 is spring-loaded and is complementary to the holes 32. The pin 36 is configured to be depressed to vertically adjust the upper segment 24 relative to the lower segment 26, allowing a user to selectively position the top plate 14 relative to the bottom plate 12. The pin 36 is positioned to insert into a respective hole 32 to fixedly position the upper segment 24 relative to the lower segment 26.

Figure 5:
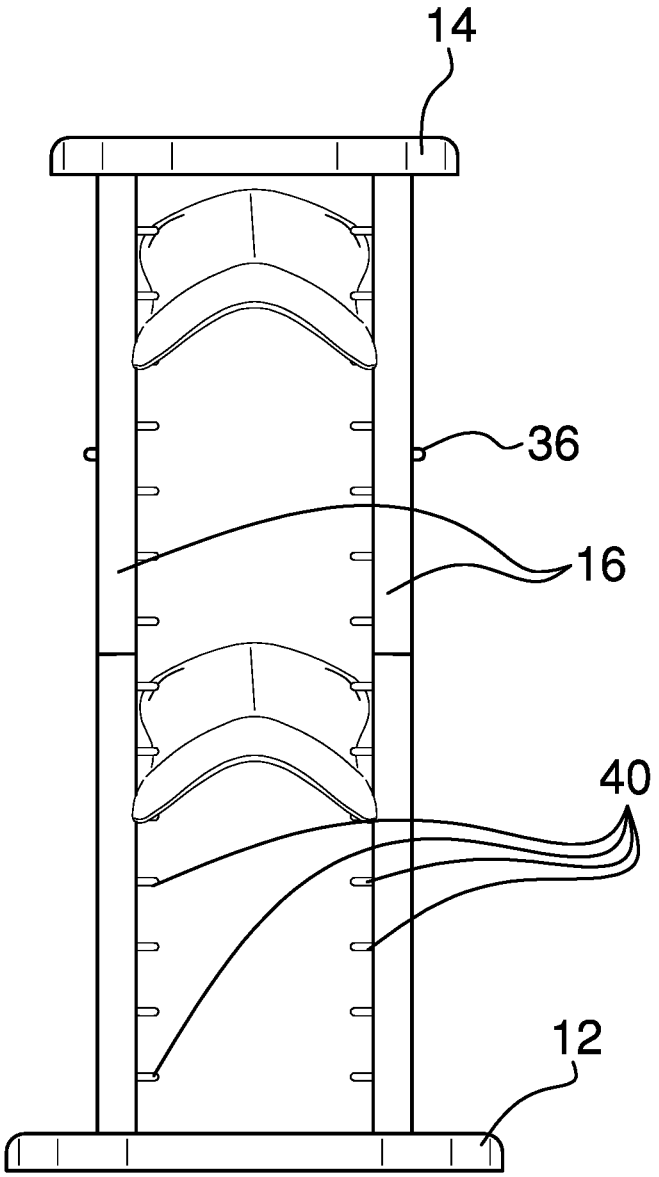
FIG. 5 is an in-use view of an embodiment of the disclosure.

Each of a plurality of pegs 40 is coupled to and extends perpendicularly from one rod 16 toward the other rod 16. The peg 40 is aligned with an associated peg 40 that is positioned on the other rod 16. The plurality of pegs 40 is configured to separate the bills of a set of caps that is coupled to the rods 16, as shown in FIG. 5. The plurality of pegs 40 comprises from ten to fifty pegs 40. The plurality of pegs 40 comprises from twenty to forty pegs 40. The plurality of pegs 40 comprises twenty-eight pegs 40.

A pair of channels 42 is positioned singly in a lower face 44 of the top plate 14 and an upper face 46 of the bottom plate 12, as shown in FIG. 3. Opposing ends 48 of the rods 16 are reversibly slidable within the pair of channels 42. The rods 16 are configured to slid toward one another to couple to the bill of the cap and to selectively fix the bill in the curved configuration and the flat configuration.

Each of a plurality of ratchets 50 extends into an associated channel 42 from a recess 52 that is positioned in a respective opposing side 54 of the associated channel 42, as shown in FIG. 2. The ratchets 50 are positioned to ratchet within the recesses 52 to allow alternate sliding of the rods 16 within the channels 42 and locking of the rods 16 in a selected configuration within the channels 42. The plurality of ratchets 50 comprises twelve ratchets 50 that define six locking sites 56.

In use, the rods 16 are positioned in the selected configuration by positioning the rods 16 in the appropriate locking sites 56 to separate the rods 16 to obtain either the curved configuration or the flat configuration of the bills of the caps. Each bill of a cap is inserted between the rods 16 above the peg 40 that is positioned on the one rod 16 and the associated peg 40 that is positioned on the other rod 16 to separate the bills of the set of caps that is coupled to the rods 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A storage rack device comprising:

a bottom plate;

a top plate;

a pair of rods coupled to and extending between the bottom plate and the top plate, the rods being opposingly positioned proximate to a lower circumference of the top plate and extending in parallel to the bottom plate wherein the pair of rods is configured for selectively inserting a bill of a cap for coupling the cap to the pair of rods such that the bill is selectively positionable in a curved configuration and a flat configuration;

a pair of channels positioned singly in a lower face of the top plate and an upper face of the bottom plate, opposing ends of the rods being reversibly slidable within the pair of channels wherein the rods are configured for sliding toward one another for coupling to the bill of the cap and for selectively fixing the bill in the curved configuration and the flat configuration; and a plurality of ratchets, each ratchet extending into an associated one of said channels from a recess positioned in a respective opposing side of the associated channel such that the ratchets are positioned for ratcheting within the recesses for alternately sliding the rods within the channels and locking the rods in a selected configuration within the channels.

2. The device of claim 1, further including the bottom plate and the top plate being circularly shaped.

3. The device of claim 1, further comprising:

the bottom plate having an upper perimeter, the upper perimeter being beveled; and the top plate having an upper circumference, the upper circumference being beveled.

4. The device of claim 1, further including the top plate being circumferentially smaller than the bottom plate.

5. The device of claim 1, further including the bottom plate, the top plate, and the rods comprising wood.

6. The device of claim 1, further including the bottom plate, the top plate, and the rods comprising plastic.

7. The device of claim 1, further including the rods being circularly shaped when viewed longitudinally.

8. The device of claim 1, further including each rod comprising:

an upper segment extending from the top plate, the upper segment being tubular;

a lower segment, the lower segment comprising a lower section and an upper section, the lower section extending from the bottom plate, the upper section extending from the lower section, the upper section being circumferentially smaller than the lower section wherein the upper section is positioned for selectively inserting into the upper segment for coupling the upper segment to the lower segment;

a plurality of holes positioned in the upper segment proximate to a lower end of the upper segment; and a pin coupled to the upper section of the lower segment proximate to an upper end of the lower segment, the pin being spring-loaded, the pin being complementary to the holes wherein the pin is configured for depressing for vertically adjusting the upper segment relative to the lower segment positioning the pin for inserting into a respective one of said holes for fixedly positioning the upper segment relative to the lower segment.

9. The device of claim 8, further including the plurality of holes comprising four holes.

10. The device of claim 1, further including a plurality of pegs, each peg being coupled to and extending perpendicularly from one of said rods toward the other of said rods such that each peg is aligned with an associated peg positioned on the other of said rods wherein the plurality of pegs is configured for separating the bills of a set of caps coupled to the rods.

11. The device of claim 10, further including the plurality of pegs comprising from ten to fifty pegs.

12. The device of claim 11, further including the plurality of pegs comprising from twenty to forty pegs.

13. The device of claim 12, further including the plurality of pegs comprising twenty-eight pegs.

14. The device of claim 1, further including the plurality of ratchets comprising twelve ratchets defining six locking sites.

15. A storage rack device comprising:

a bottom plate, the bottom plate being circularly shaped, the bottom plate having an upper perimeter, the upper perimeter being beveled;

a top plate, the top plate being circularly shaped, the top plate having an upper circumference, the upper circumference being beveled, the top plate being circumferentially smaller than the bottom plate;

a pair of rods coupled to and extending between the bottom plate and the top plate, the rods being opposingly positioned proximate to a lower circumference of the top plate and extending in parallel to the bottom plate wherein the pair of rods is configured for selectively inserting a bill of a cap for coupling the cap to the pair of rods such that the bill is selectively positionable in a curved configuration and a flat configuration, the rods being circularly shaped when viewed longitudinally, each rod comprising:

an upper segment extending from the top plate, the upper segment being tubular, a lower segment, the lower segment comprising a lower section and an upper section, the lower section extending from the bottom plate, the upper section extending from the lower section, the upper section being circumferentially smaller than the lower section wherein the upper section is positioned for selectively inserting into the upper segment for coupling the upper segment to the lower segment, a plurality of holes positioned in the upper segment proximate to a lower end of the upper segment, the plurality of holes comprising four holes, and a pin coupled to the upper section of the lower segment proximate to an upper end of the lower segment, the pin being spring-loaded, the pin being complementary to the holes wherein the pin is configured for depressing for vertically adjusting the upper segment relative to the lower segment positioning the pin for inserting into a respective one of said holes for fixedly positioning the upper segment relative to the lower segment;

a plurality of pegs, each peg being coupled to and extending perpendicularly from one of said rods toward the other of said rods such that each peg is aligned with an associated peg positioned on the other rod wherein the plurality of pegs is configured for separating the bills of a set of caps coupled to the rods, the plurality of pegs comprising from ten to fifty pegs;

a pair of channels positioned singly in a lower face of the top plate and an upper face of the bottom plate, opposing ends of the rods being reversibly slidable within the pair of channels wherein the rods are configured for sliding toward one another for coupling to the bill of the cap and for selectively fixing the bill in the curved configuration and the flat configuration; and a plurality of ratchets, each ratchet extending into an associated channel from a recess positioned in a respective opposing side of the associated one of said channels such that the ratchets are positioned for ratcheting within the recesses for alternately sliding the rods within the channels and locking the rods in a selected configuration within the channels, the plurality of ratchets comprising twelve ratchets defining six locking sites.

16. The device of claim 15, further including the bottom plate, the top plate, and the rods comprising plastic.

17. The device of claim 15, further including the bottom plate, the top plate, and the rods comprising wood.

* * * * *